US005451437A

United States Patent [19]

Insley et al.

[11] Patent Number: 5,451,437

[45] Date of Patent: Sep. 19, 1995

[54] METHOD AND ARTICLE FOR PROTECTING A CONTAINER THAT HOLDS A FLUID

[75] Inventors: Thomas I. Insley, Lake Elmo, Minn.; Tommie N. Lee, Omaha, Nebr.; Beth A. Schraeder, Roseville, Minn.

[73] Assignee: Minnesota Mining and Manufacturing Company, St. Paul, Minn.

[21] Appl. No.: 80,875

[22] Filed: Jun. 21, 1993

[51] Int. Cl.[6] ..... B65D 81/26

[52] U.S. Cl. ..... 428/35.2; 428/35.5; 428/36.1; 428/36.4; 428/36.92; 428/192; 428/206; 428/286; 428/298; 428/903; 383/107; 383/114; 206/484.2; 206/524.5

[58] Field of Search ..... 206/524.5, 484, 484.1; 383/107, 109, 114; 428/36.1, 36.4, 35.2, 35.5, 36.92, 283, 286, 297, 298, 326, 372, 903, 913, 192, 193, 206

[56] References Cited

U.S. PATENT DOCUMENTS

| | | | |
|---|---|---|---|
| 1,975,253 | 10/1934 | Connolly | 206/484 |
| 3,016,599 | 1/1962 | Perry, Jr. . | |
| 3,164,695 | 1/1965 | Sanni | 206/484 |
| 3,209,977 | 10/1965 | Lewis et al. | 383/107 |
| 3,948,436 | 4/1976 | Bambara | 428/193 |
| 4,087,002 | 5/1978 | Bambara et al. | 383/107 |
| 4,100,324 | 7/1978 | Anderson et al. | 428/326 |
| 4,213,528 | 7/1980 | Kreutz et al. | 206/205 |
| 4,337,862 | 7/1982 | Suter | 206/632 |
| 4,429,001 | 1/1984 | Kolpin et al. | 428/297 |
| 4,756,937 | 7/1988 | Mentzer | 428/35 |
| 4,813,948 | 3/1989 | Insley | 604/366 |
| 4,861,632 | 8/1989 | Caggiano | 428/35.2 |
| 4,868,025 | 9/1989 | Strzelewicz | 428/35.2 |
| 4,874,094 | 10/1989 | Blanke, Jr. | 206/522 |
| 4,884,684 | 12/1989 | Bernardin et al. | 206/204 |
| 4,925,711 | 5/1990 | Akao et al. | 383/109 |
| 4,927,010 | 5/1990 | Kannankeril | 206/204 |
| 4,949,840 | 8/1990 | Brown | 206/204 |
| 4,964,509 | 10/1990 | Insley et al. | 206/204 |
| 4,972,945 | 11/1990 | Insley et al. | 206/204 |
| 4,988,560 | 1/1991 | Meyer et al. . | |
| 5,024,865 | 6/1991 | Insley et al. | 428/36.4 |
| 5,029,699 | 7/1991 | Insley et al. | 206/204 |

FOREIGN PATENT DOCUMENTS

0336107A2 10/1989 European Pat. Off. .

OTHER PUBLICATIONS

U.S. Patent Application Serial No. 08/010,565 entitled "*Sorbent Articles*" filed Jan. 28, 1993.

U.S. Patent Application Serial No. 08/011,403 entitled "*Method of Making Sorbent Articles*" filed Jan. 28, 1993.

*Primary Examiner*—Ellis P. Robinson
*Assistant Examiner*—Rena L. Dye
*Attorney, Agent, or Firm*—Gary L. Griswold; Walter N. Kirn; Karl G. Hanson

[57] ABSTRACT

A method and article for protecting a container that contains a fluid.

The method includes the steps of: (a) providing a container that holds a fluid and that has first and second ends, a side, and a length; (b) providing a conformable nonwoven web that contains at least 5 weight percent microfibers based on the weight of fibrous material in the nonwoven web, the conformable nonwoven web having a length in at least one dimension that is substantially greater than the length of the container; and (c) wrapping the conformable nonwoven web at least one full turn about the container such that (i) the container forms an axis about which the web is wrapped and (ii) first and second portions of the nonwoven web project axially from the first and second ends of the container.

The article includes a conformable sleeve having a tubular body that has an opening sized to permit a container to enter the interior of the conformable sleeve. A nonwoven web containing microfibers is employed in the tubular body of the sleeve to protect the container and sorb fluid which would leak from the container in the event of a failure.

17 Claims, 3 Drawing Sheets

METHOD AND ARTICLE FOR PROTECTING A CONTAINER THAT HOLDS A FLUID

TECHNICAL FIELD

This invention pertains to a method and article for protecting a fragile container from breakage. The method and article also allow a fluid, which leaked from a broken container, to be retained in a sorbent structure in the immediate vicinity of the broken container.

BACKGROUND OF THE INVENTION

Transporting hazardous fluids in containers is fraught with the risk that the container may break, allowing the hazardous fluid to enter the environment. To reduce this risk, articles have been designed which protect the container from breakage and, should the container fail, retain the hazardous fluid in the immediate vicinity of the broken container. Polymeric microfibers have been employed in these kinds of articles to protect the container and/or sorb fluid that leaves the container during a breakage. Examples of such articles have been disclosed in the following U.S. Pat. Nos.: 5,029,699; 5,024,865; 4,972,945; 4,964,509; and 4,884,684. Although the articles disclosed in these patents serve the two-fold purpose of protecting the container and retaining any escaped fluid, the articles are relatively bulky and rigid in construction and therefore lack the versatility and conformability necessary to allow them to be used for protecting containers of a variety of shapes and sizes.

SUMMARY OF THE INVENTION

The present invention provides a new method and article for protecting a container and sorbing fluid which is unintentionally released from the container.

The method of the invention comprises:

providing a container that holds a fluid and that has first and second ends, a side, and a length;

providing a conformable nonwoven web that contains at least 5 weight percent microfibers based on the weight of fibrous material in the nonwoven web, the conformable nonwoven web having a length in at least one dimension that is substantially greater than the length of the container; and wrapping the conformable nonwoven web at least one full turn about the container such that the container forms an axis about which the web is wrapped and first and second portions of the nonwoven web project axially from the first and second ends of the container.

The method of the invention has the advantage of being simple yet versatile. Containers of various sizes and shapes can be protected from impact by wrapping a conformable nonwoven web that contains microfibers about the container. The conformable nonwoven web is dimensioned so that the whole container can be protected from impact when the conformable nonwoven web is wrapped thereabout. The sides of the container are protected by being surrounded by the wrapped nonwoven web, and the ends of the container are protected by the extra web length which projects axially from the ends of the container. The microfiber in the nonwoven web can sorb a hazardous liquid should the container fail.

In a preferred embodiment of the method of the invention, the conformable nonwoven web is configured in the shape of a sleeve. A nonwoven web configured as such embodies the article of the invention, which briefly comprises: a conformable sleeve that includes a tubular body that has an interior sized to receive the container that holds a fluid and an opening sized to permit the container to enter the interior of the tubular body, wherein the tubular body comprises a nonwoven web that contains at least 5 weight percent microfibers based on the weight of fibrous material in the nonwoven web.

The conformable sleeve includes a tubular body that contains microfibers and has a size and conformability which enable it to be wrapped about a container holding a hazardous fluid. The sleeve is sized so that the container can be placed in the interior of the conformable sleeve through the opening. The sleeve is conformable so that it can be readily wrapped about the container.

The method and article of the invention can protect fragile containers to a degree sufficient to pass the Federal Drop Test defined in 49 C.F.R. § 178.603 (Oct. 1, 1992).

The above and other advantages of the invention are more fully shown and described in the drawings and detailed description of this invention, where like reference numerals are used to represent similar parts. It is to be understood, however, that the drawings and description are for the purposes of illustration only and should not be read in a manner that would unduly limit the scope of the invention.

DETAILED DESCRIPTION OF PREFERRED EMBODIMENTS

Figure 1:
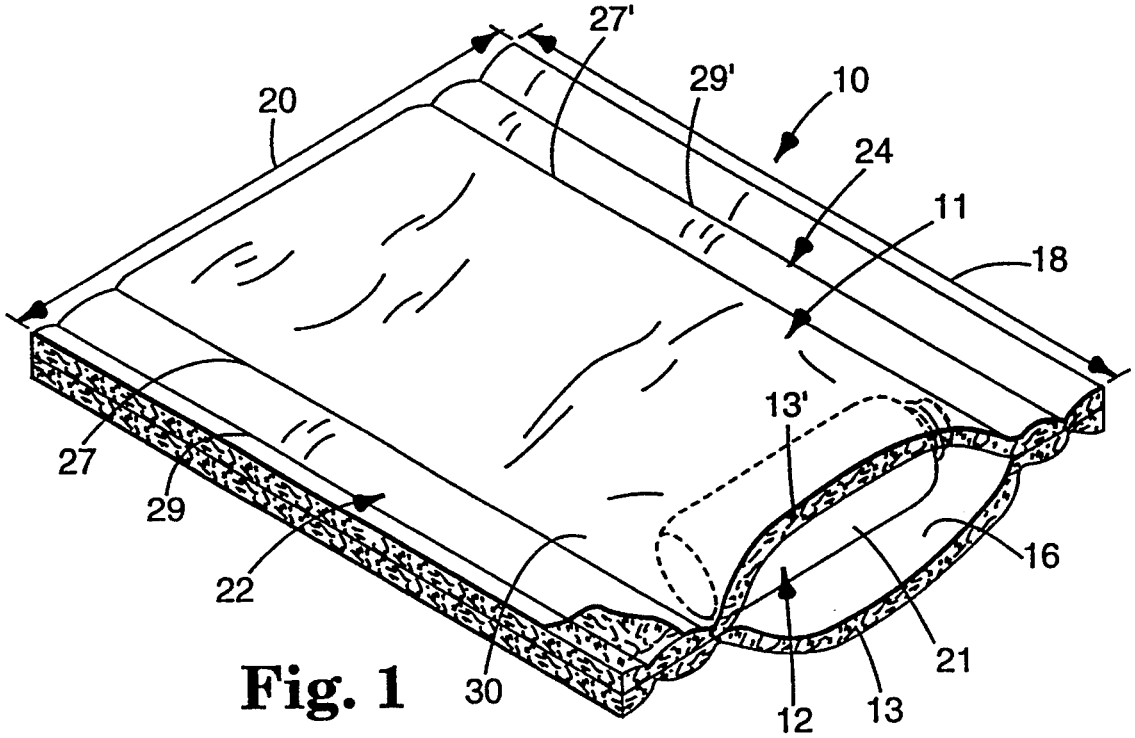
FIG. 1 is a perspective view of a conformable sleeve 10 in accordance with the present invention.

In describing the preferred embodiments of the invention, specific terminology will be used for the sake of clarity. The invention, however, is not intended to be limited to the specific terms so selected, and it is to be understood that each term so selected includes all the technical equivalents that operate similarly.

In the practice of the present invention, a conformable nonwoven web that contains microfibers is wrapped at least one full turn about a container that holds a hazardous fluid to protect the container from impact and to sorb fluid from the container in the event the container fails. The conformable nonwoven web is wrapped at least one full turn about the container to surround the side of the container to protect the same from impact. When wrapped about the container, portions of the nonwoven web project axially from each end of the container to protect those parts of the container from impact. Preferably, the container is disposed centrally in the wrapped nonwoven web so that both ends are equally projected.

The nonwoven web that is employed in this invention contains at least 5 weight percent microfibers based on the weight of fibrous material in the nonwoven web. A preferred nonwoven web comprises at least about 20 weight percent microfibers, more preferably at least about 50 weight percent microfibers, and up to 100 weight percent microfibers. The term microfiber means a fiber that has a diameter of less than approximately 10 micrometers. A preferred nonwoven web contains microfibers that have an average fiber diameter of about 5 to 8 micrometers. The fiber diameter can be calculated according to the method set forth in Davies, C. N., "The Separation of Airborne Dust and Particles", Institution of Mechanical Engineers, London, Proceedings IB, (1952). The nonwoven web preferably has a substantially uniformly distributed microfibrous structure throughout the whole web.

The nonwoven web that contains microfibers preferably has a solidity less than about 0.2 and generally greater than about 0.03. The term "solidity" means the volume of fibers per volume of web. Solidity can be calculated using the following formula:

$$S = \frac{\rho_b}{\sum_{i=1}^{n} x_i \rho_i}$$

where:

$\rho_b$ is the bulk density of the web, which is the weight of the web divided by the volume of the web;

$x_i$ is the weight fraction of component i;

$\rho_i$ is the density of component i;

S is the solidity; and n is the number of components.

Preferably, the nonwoven web has a solidity in the range of about 0.04 to 0.15, and more preferably in the range of about 0.06 to 0.12.

The thickness of the nonwoven web may vary depending on such factors as the size of the container desired to be protected, the weight of the container, the weight of the container's contents, and the number of wrappings. Typically, however, the nonwoven web has a thickness of about 0.2 to 5 cm, and more typically 0.5 to 2 cm.

The nonwoven web that contains microfibers generally has a basis weight greater than 50 grams per square meter ($g/m^2$) and up to approximately 600 $g/m^2$. Typically, the basis weight is in the range of about 100 to 400 $g/m^2$.

The sorbent capacity of the nonwoven web is generally in the range of about 5 to 40 grams $H_2O$ per gram web ($gH_2O/g$ web), and more typically in the range of about 15 to 20 $gH_2O/g$ web. The sorbent capacity can be measured according to the tests described in the Examples set forth below.

The nonwoven web preferably has sufficient tensile strength to allow the web to maintain its integrity during handling. The web preferably demonstrates a tensile strength when wet which is essentially the same as the tensile strength when dry. The nonwoven web therefore does not significantly lose strength upon sorbing a liquid and thus can retain broken fragments of the container, as well as the escaped fluid. In general, the nonwoven web's dry (and preferably wet) tensile strength is greater than about 0.5 Newtons per centimeter (N/cm), typically about 1 to 8 N/cm. Tensile strength can be determined using the test outlined in Examples below.

The nonwoven web preferably has a flexural rigidity low enough to enable the sleeve 10 to be conformable. The flexural rigidity generally is less than about 40 gram-centimeters (g-cm), preferably less than 20 about g-cm. Flexural rigidity can be measured according to ASTM test method D1388-64 using option A, the Cantilever Test.

The microfibers in nonwoven web are entangled as a coherent mass of fibers. The fibers can be entangled by, for example, a melt-blowing process, where a molten polymer is forced through a die and the extruded fibers are attenuated by adjacent high velocity air streams to form an entangled mass of blown microfiber (BMF). A process for making BMF webs is disclosed in Wente, Van A., "Superfine Thermoplastic Fibers" 48 *Industrial Engineering Chemistry,* 1342 et seq (1956); or see Report No. 4364 of the Naval Research Laboratories, published May 25, 1954, entitled "Manufacture of Super Fine Organic Fibers" by Wente, Van A.; Boone, C. D.; and Fluharty, E. L. A nonwoven web of microfiber may also be made using solution blown techniques such as disclosed in U.S. Pat. No. 4,011,067 to Carey or electrostatic techniques such as disclosed in U.S. Pat. No. 4,069,026 to Simm et al.

Polymeric components that may be used to form a BMF web include polyolefins such as polyethylene, polypropylene, polybutylene, poly(4-methylpentene-1), and polyolefin copolymers; polyesters such as polyethylene terephthalate (PET), polybutylene terephthalate, and polyether ester copolymers such as HYTREL available from Dupont Co., Elastomers Division, Wilmington, Del.; polycarbonates; polyurethanes; polystyrene; polyamides such as nylon 6 and nylon 66; and thermoplastic elastomer block copolymers such as styrene-butadiene-styrene, styrene-isoprene-styrene, styrene-ethylene/butylene-styrene, available from Shell Oil Company, Houston, Tex., under the trademark KRATON. Combinations of the above polymeric microfibers, or blends of the polymeric components, may also be employed. For example, a blend of polypropylene and poly(4-methyl-1-pentene) can be used to make a nonwoven web that contains microfiber (see U.S. Pat. No. 4,874,399 to Reed et at.), or the web may contain bicomponent microfiber such as the polypropylene/-polyester fibers (see U.S. Pat. No. 4,547,420 to Krueger et al.) Polymers useful for forming microfibers from solution include polyvinyl chloride, acrylics and acrylic copolymers, polystyrene, and polysulfone. A nonwoven web preferably comprises microfibers made from polyolefins, particularly fibers that contain polypropylene as a major fiber component, for example, greater than ninety weight percent, because such fibers provide the web with good cushioning properties in conjunction with good sorptive properties.

In addition to microfibers, the nonwoven web may contain other fibers such as crimped or uncrimped staple fibers. The addition of staple fibers can impart better conformability and improved loft to the nonwoven web. Staple fibers are fibers of a given fineness, crimp, and cut length. Fineness is generally given in units of tex, grams per kilometer (g/km), a linear density. Crimp is characterized by the number of bends per unit length of fiber (crimps/centimeter). Cut length is the overall length of the cut filaments. Staple fibers employed in this invention generally have fineness of about 0.1 to 10 tex, preferably about 0.3 to 4 tex, crimp densities of about 1 to 10 crimps/cm, preferably at least 2 crimps/cm, and cut lengths in the range of about 2 to 15 centimeters, preferably about 2 to 10 centimeters. Webs that contain staple fibers may be prepared according to procedures discussed in U.S. Pat. No. 4,988,560 to Meyer et al., U.S. Pat. No. 4,118,531 to Hauser, and U.S. Pat. No. 3,016,599 to Perry. When added to a nonwoven web that contains microfibers, staple fibers typically comprise approximately 10 to 50 weight percent of the fibrous material in the nonwoven web.

A nonwoven web that contains microfibers as carrier fibers (and optionally staple fibers) may also contain microfiber microwebs as sorbent structures in the nonwoven web. In conjunction with providing good sorbency, microfiber microwebs can also impart better conformability to the nonwoven web. Microfiber microwebs have a relatively dense nucleus with numerous individual fibers and/or fiber bundles extending therefrom. The extended fibers and fiber bundles provide an anchoring means for the microfiber microwebs when they are incorporated into the nonwoven web. The nucleus of the microfiber microwebs preferably is in the range of about 0.2 to 2 mm. The extending fibers and/or fiber bundles preferably extend beyond the nucleus to provide an overall diameter of about 0.07 to 10 mm, more preferably about 0.2 to 5 min. The diameter of the microfibers in the microfiber microweb can be similar in diameter to, or smaller than, the microfibers of the carrier microfiber web. The microfibers of the microfiber microwebs can be smaller in diameter than is normally considered suitable for use in microfiber webs because the staple fibers or the carrier microfibers in the nonwoven webs are major contributors to the strength of the nonwoven webs. Preferably smaller in diameter than the carrier microfibers of the nonwoven web, the microfibers in the microfiber microwebs can be at least 20 percent smaller and more preferably at least 50 percent smaller than the carrier microfibers in the nonwoven web. Fibers having smaller diameters can increase the capillary action in the microfiber microwebs to enhance absorptive properties for retaining liquids. When employed in a nonwoven web that contains microfibers, microfiber microwebs are generally present in the nonwoven web in the range of about 10 to 80 weight percent based on the weight of fibrous material. Microfiber microwebs and their manufacture are described in U.S. Pat. No. 4,813,948 to Insley, the disclosure of which is incorporated here by reference.

A nonwoven web that contains microfibers and optionally staple fibers and/or microfiber microwebs may also include other ingredients in addition to the fibrous material. For instance, the nonwoven web of microfibers may be loaded with discrete solid particles capable of interacting with (for example, chemically or physically reacting with) a fluid to which the particles are exposed. Such particles can remove a component from a fluid by sorption, chemical reaction, or amalgamation or a catalyst may be employed to convert a hazardous fluid to a harmless fluid. An example of a particle-loaded nonwoven web of microfiber is disclosed in U.S. Pat. No. 3,971,373 to Braun, where discreet solid particles of activated carbon, alumina, sodium bicarbonate, and/or silver are uniformly dispersed throughout and are physically held in the web to adsorb a gaseous fluid; see also, U.S. Pat. No. 4,100,324 to Anderson et al. and U.S. Pat. No. 4,429,001 to Kolpin et al. Also, additives such as dyes, pigments, fillers, surfactants, abrasive particles, light stabilizers, fire retardants, absorbents, medicaments, et cetera, may also be added to the web by introducing such components to the fiber-forming molten polymers or by spraying them onto the fibers after the web has been collected.

The conformable nonwoven web that contains microfibers preferably is configured in the form of a conformable sleeve. In FIG. 1 a conformable sleeve 10 is shown which comprises a tubular body 11 that contains a nonwoven web 13, 13' that contains polymeric microfibers. An opening 16 is located at an end of tubular body 11 and is sized to permit a container 12 to be placed in the interior of sleeve 10. A second and similarly sized opening may be disposed at the opposite end of the tubular body 11. The conformable sleeve 10 has lengthwise and crosswise dimensions 18 and 20, respectively, where the lengthwise dimension 18 is parallel to the axis of the tubular body, and the crosswise dimension 20 is normal thereto. At least one of the lengthwise and crosswise dimensions 18 and 20 has a length that is substantially greater than the length of the container 12 that is placed in the interior of the tubular body 11. Preferably, the conformable sleeve 10 has a length in the lengthwise 18 and/or crosswise dimension 20 that is at least about 130 percent, more preferably at least about 150 percent of the length of the container. At the upper end, the length of the sleeve 10 in the lengthwise 18 and/or crosswise dimension 20 typically is less than about 400 percent, and more typically less than about 300 percent of the length of the container.

The sleeve 10 preferably has first and second bumper elements 22 and 24 located on an exterior of tubular body 11. Bumper elements 22 and 24 project laterally from the tubular body 11 and extend longitudinally along its lengthwise dimension 18. The bumper elements 22 and 24 are preferably integral with tubular body 11; that is, the bumper elements 22 and 24 and tubular body 11 are preferably made from the same web or webs of material at the same time and are not subsequently pieced together from separate components.

Conformable sleeve 10 shown in FIG. I has two nonwoven webs 13, 13' joined together at longitudinal seams 27, 27' to form tubular body 11 and bumper elements 22 and 24. A second longitudinal seam 29, 29' spaced laterally from seams 27, 27' can be provided in each bumber element 22 and 24 for holding the ends of the web together and to provide additional structural integrity to the bumper elements 22 and 24. Although two webs 13, 13' are employed in the illustrated sleeve 10, one web may be used to form the conformable sleeve or a number of nonwoven webs that contain microfibers may be layered upon each other to provide sufficient cushioning and sorptivity.

In addition to a nonwoven web that contains microfibers, a conformable sleeve 10 may comprise other layers such as a nonwoven scrim, a foamed plastic, a polymeric film, or the like. A scrim 30, for example, may be juxtaposed on one or both sides of the nonwoven web 13, 13' that contains microfibers to assist in maintaining the integrity of the web. Seam bonds 27, 27', and 29, 29' in the form of ultrasonic welds may be used to secure the scrim 30 to the nonwoven web 13, 13'. Alternative methods of securement may include mechanical fastening such as sewing or adhesive bonding. The scrim 30 preferably adds significant tensile strength to the tubular body 11 over that provided by nonwoven web 13, 13' . An increase in tensile strength can be helpful in retaining fragments of a broken container. The tensile strength of the tubular body 11 preferably is greater than about 2 N/cm, more preferably in the range of about 3 to 20 N/cm.

The tubular body 11 and bumper elements 22 and 24 preferably each have cushioning and sorptive properties to enable conformable sleeve 10 to protect a container placed therein and to sorb fluid that leaked from the container in the event of a breakage. The term "cushioning properties" means possessing a resiliency sufficient to allow the tubular body 11 or bumper element 22, 24 to be compacted and return substantially to its original dimensions, and the term "sorptive properties" means the ability to sorb and retain fluids. The above-described nonwoven web that contains microfibers can provide sufficient cushioning and sorptive properties for the tubular body 11 and bumper elements 22 and 24.

Figure 2:
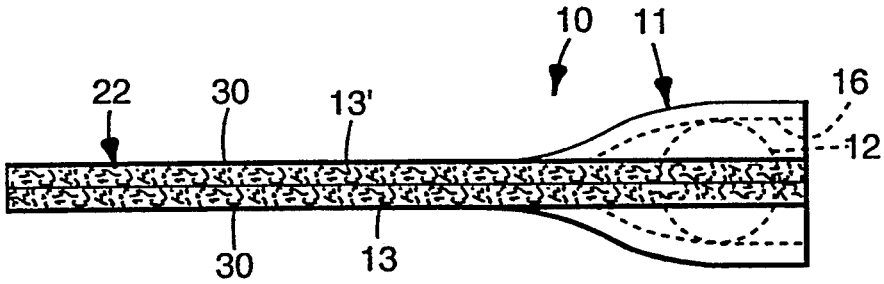
FIG. 2 is a side view of a conformable sleeve 10 in accordance with the present invention having a container 12 placed therein.
Figure 3:
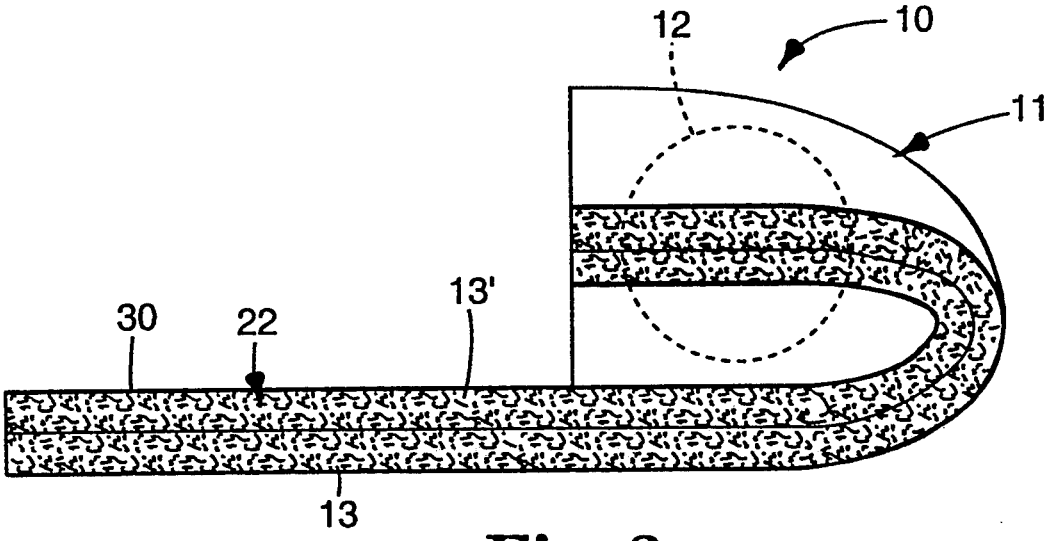
FIG. 3 is a side view of a conformable sleeve 10 in accordance with the present invention having a container 12 placed therein and partially wrapped thereabout.
Figure 4:
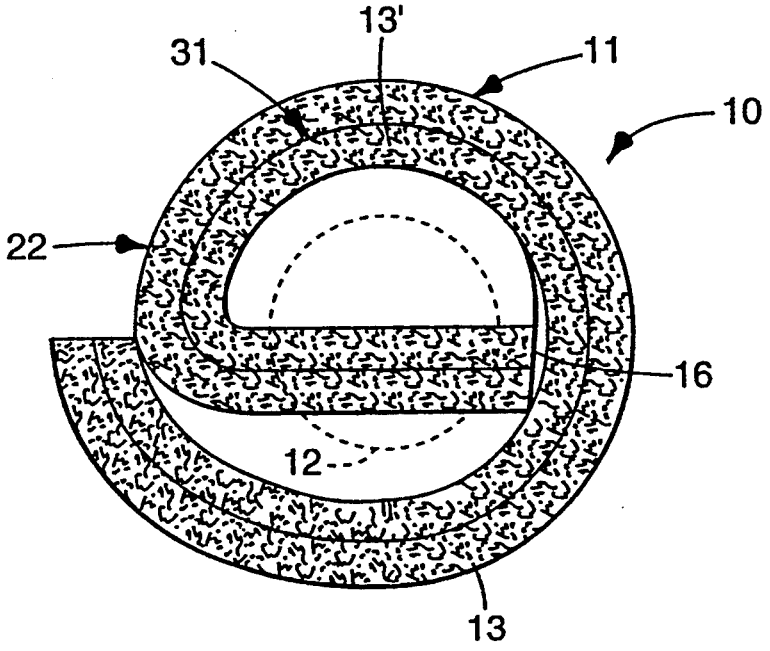
FIG. 4 is a side view of a conformable sleeve 10 wrapped about a container 12 in accordance with the present invention.
Figure 5:
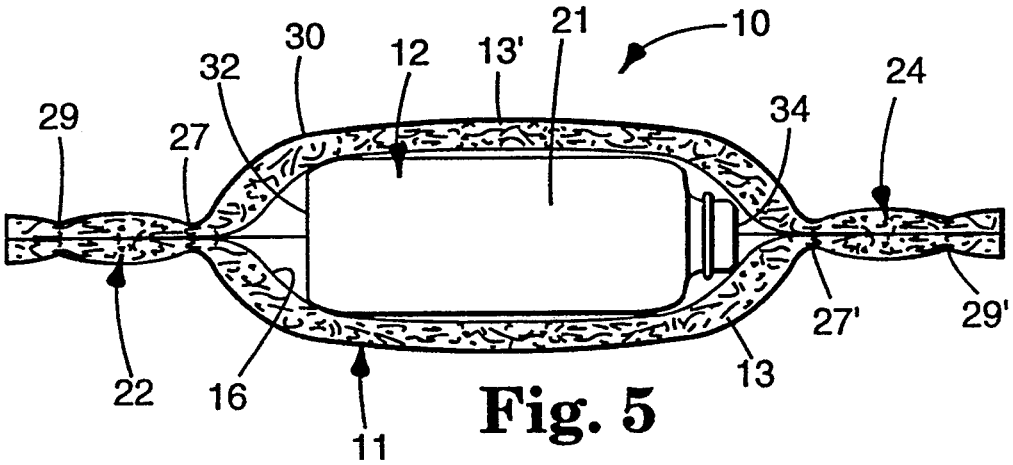
FIG. 5 is a end view of a conformable sleeve 10 in accordance with the present invention having a container 12 placed therein.

Referring to FIGS. 2–4, it is shown how a fragile container 12 (for example, a glass container) can be wrapped in conformable, sorbent sleeve 10. Container 12 is first placed in the conformable sleeve 10 by passing the container 12 through opening 16 in tubular body 11. Opening 16 extends along the crosswise dimension 20 of sleeve 10, and the container 12 is placed in sleeve 10 such that the container 12 is parallel to the crosswise dimension 20. The crosswise dimension 20 is substantially greater in length than the length of the container 12 (FIGS. 1 and 5). The container preferably is positioned centrally along the crosswise dimension. The sleeve 10 is then wrapped about the container 12 by rolling the container 12 in the sleeve's lengthwise dimension. The container 12 thereby forms an axis about which the conformable sleeve 10 is wrapped, and this axis is generally parallel to the crosswise dimension 20 of sleeve 10. In FIG. 3, the sleeve is shown to be wrapped one-half turn or 180 degrees about the container. To fully surround the container's side 21 (FIGS. 1 and 5), the wrapping continues until a wrapping of one full turn or 360 degrees is accomplished. Further wrappings may be needed to provide sufficient cushioning and sorptive properties to protect the container and sorb all the fluid should the container break. In FIG. 4, the sleeve is shown wrapped one and one-half turns or 540 degrees about the container. A wrapping of one and half turns can be more desirable because it allows the whole side 21 (FIGS. 1 and 5) to be protected by three layers of web.

Although the sleeve 10 illustrated in FIGS. 2–4 is wrapped about the container 12 along the lengthwise dimension, a conformable sleeve may also be wrapped about the container in the opposite direction along the crosswise dimension. In such a situation, sleeve 10 would have a length in the lengthwise dimension 18 which is greater than the length of the container 12.

As best shown in FIG. 4, upon wrapping the sleeve about the container, the first and second bumper elements 22 and 24 each form a generally spirally-configured bumper element 31 at each end of article 10. The spirally-configured bumper elements 31 project axially from each end to protect the same from impact. Looking particularly at FIG. 5, it can be seen how the tubular body 11 is closed at seam 27 and the bumper elements 22 and 24 are located on the exterior of the tubular body 11. This prevents the container 12 from entering the bumper elements 22 and 24 during movement or shifting of the wrapped containers. If the container 12 was able to enter a bumper element, the first and second ends 32 and 34 (top and bottom) of container 12 could lose protection from impact on that end of the container.

Figure 6:
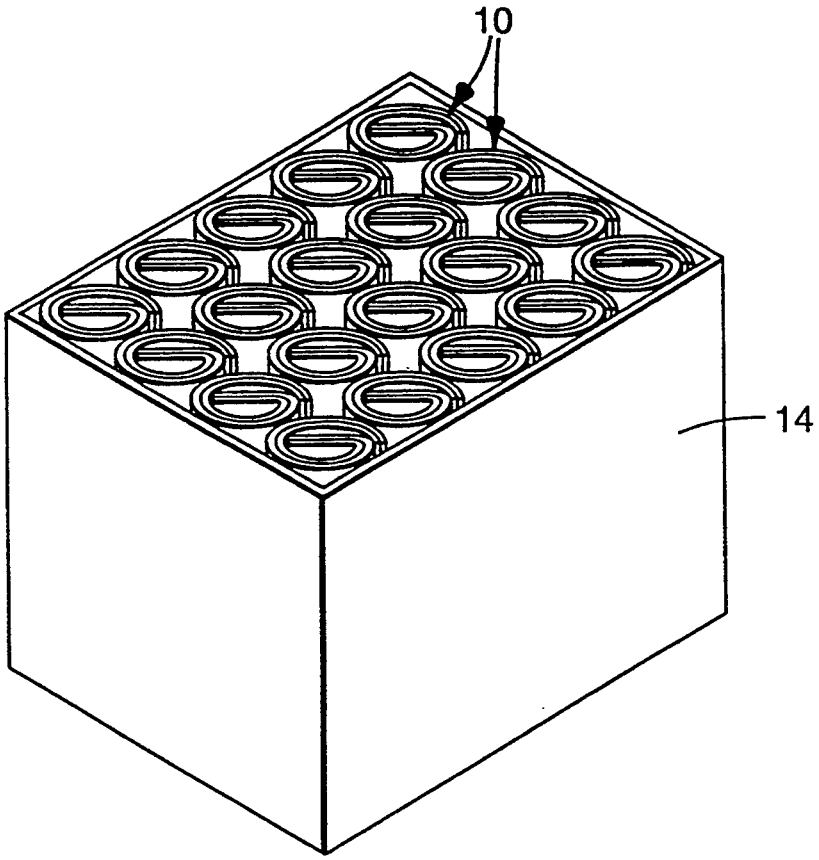
FIG. 6 is a perspective view of sixteen sleeves 10 each wrapped about a container and placed in a box 14 in accordance with the present invention.

The conformable sleeve 10 can be held in a wrapped condition about the container 12 using a fastener such as an adhesive, tape, a hook and loop fastener, string, cord, wire, twine, and the like. Alternatively, as shown in FIG. 6, a number of wrapped sleeves 10 protecting containers, may be placed in a second container such as box 14 to hold the sleeves 10 in their wrapped condition and to allow a number of containers to be transported together to a distant location. The wrapped containers preferably are placed upright in box 14, with the axis of the wrapped container normal to the box bottom. Packing the wrapped containers in this manner allows the extra sleeve length, which projects axially from the ends of the container, to receive most of the impact if box 14 is dropped.

Illustrative examples of hazardous fluids that may be present in containers protected by the method and article of the invention include those that may be flammable, poisonous, and/or corrosive, including acrylonitriles, alkaloids, bromine, caustic alkalis, 2-chloropropane, chlorosulphonic acid, cyanide solutions, diethyl ether, disinfectants, dyes, ethyl mercaptan, fluorosulphonic acid, furans, methyl formate, naptha, methanol, acetone, alcoholic beverages having high alcohol content (>70 vol. % ), battery fluids, benzene, carbon tetrachloride, chloroform, gasoline, n-Heptane, hexanes, isopropanol, methanol, nicotine, and sulfuric acid.

Features and advantages of this invention are further illustrated in the following examples. It is to be expressly understood, however, that while the examples serve this purpose, the particular ingredients and amounts used, as well as other conditions and details are not to be construed in a manner that would unduly limit the scope of this invention.

EXAMPLES

The following tests were used to define properties of the nonwoven web.

Sorbent Capacity Test

Sorbent capacity was determined by lowering a sample of web, 21.6 ×27.9 centimeters (cm), on a tray with a drain screen into a oil bath. Mineral oil (Klearol white mineral oil available from Witco, Sonnebom Division, Petrolia, La.) used in the bath had at 25° C a viscosity of 11 centipoise and a density of 0.825 grams per cubic centimeter (g/cm$^3$). The sample was allowed to rest on the surface of the oil for one minute and, if not saturated, submerged in the oil. After an additional two minutes, the sample was removed from the oil using the drain screen and allowed to drain for two minutes. The amount of oil remaining in the sample was determined. Oil sorption is the amount of oil remaining in the sample per dry sample weight and is reported in g/g.

Tensile Strength Test

Tensile strength was determined using an INSTRON tensile tester Model 4302, available from Instron Corporation, having a jaw spacing of 25.4 cm and jaw faces 7.62 cm wide. A 2.54 cm wide dry sample is tested at a crosshead speed of 12.7 cm/min. Wet tensile strength is determined by saturating the web in water before placing the web in the tensile tester. The peak tensile is recorded in N/cm.

Fabric Stiffness Test

Fabric stiffness was determined using ASTM Test Method D1388-64 using the option A, the Cantilever Test, and was reported as flexural rigidity in g-cm.

Bulk Web Density Test

Web density was determined by measuring the thickness and weight of a 10 cm×12 cm sample of web. The thickness of samples was determined using a low-load caliper tester Model No. CS-49-051, available from Custom Scientific Instruments, Inc., with a 1.22 g balance weight. Sample weight was determined using a top loading balance Model No. PE 3600, available from Mettler Instrument Corporation. Sample volume is calculated by multiplying the sample thickness by the area of the sample. Density is determined by dividing the sample weight by the sample volume and is reported in g/cm$^3$.

Example 1

Microfiber microwebs were prepared by first forming a nonwoven source web of polymeric microfibers and then mechanically divellicating the source web. The nonwoven source web was prepared according to a conventional melt blowing method, see supra Wente, Van A., using polypropylene (Fina 100 melt flow, available from Fina Oil and Chemical Co.). Microfibers in the nonwoven source web were treated with 10 wt % nonionic surfactant, (Hyonic OP-9, available from Henkel Corp.) using a melt injection method described in U.S. Pat. No. 5,064,578. The microfibers of the nonwoven source web had an average fiber diameter of 8 micrometers, and the web had a basis weight of 407 g/m$^2$ and solidity of 0.08. The nonwoven source web was mechanically divellicated by use of a lickerin. The lickerin had a tooth density of 6.2 teeth/cm$^2$, an outside diameter (to the tips of the teeth) of 35.6 cm, and a rotating speed of 1700 revolutions per minute (rpm).

A nonwoven carrier web of microfibers was formed in the same manner as the nonwoven source web. During formation of the carrier web the microfiber microwebs were blown into the microfiber streams. The resulting nonwoven web was collected on a 17 g/m$^2$ polypropylene spunbonded scrim, (Fiberweb North America, Inc.) as it passed over a collection device. The microfiber microwebs comprised 38 weight percent of the fibrous material in the resulting nonwoven web. The resulting nonwoven web had a basis weight of 387 g/m$^2$, a solidity of 0.06, a sorbency of 18 g/g, a tensile strength of 1.6 N/cm, and a flexural rigidity of 10.6 g-cm. Wet and dry nonwoven webs exhibited similar tensile strengths. The nonwoven web secured to the scrim exhibited a tensile strength of 6.5 N/cm and a flexural rigidity of 12.2 g-cm, and had a total thickness of about 7 mm.

The resulting nonwoven web was used to form a sleeve configured similar to the sleeve shown in FIG. 1. The sleeve was produced by welding opposite edges of two 35 cm×54 cm sheets of the resulting nonwoven web on the scrim. The sheets were ultrasonically welded with the scrim side facing out using a stationary welder, (Series 800, available from Branson Sonic Power Company). Linear density of the welds was 2.2 points/cm. Two parallel weld lines were placed along the 54 cm lengthwise dimension adjacent to the edges of the sheets. Welds were placed 3 cm and 6 cm from the edge of the sheets. A central opening having a circumference of 46 cm was provided to accept the bottle for testing.

A test package was assembled by first placing the bottle crosswise (ends towards the welds) in the opening of the sleeve. The bottle was then rolled in the lengthwise direction of the sleeve. The sides of the bottle were surrounded by the nonwoven web and approximately 8.85 cm of web projected axially from each end of the container. Crosswise dimension of the sleeve was 202 percent of the length of the container. Wrapped in the sleeve, the bottle was placed into a 9.5×11.5×27 cm paper corrugated box of 1379 kilo pascal (KPa) burst strength (Liberty Carton Co.). The box was taped closed and submitted to the prescribed series of drops.

The sleeve was evaluated using drop tests specified for Packaging Group I liquids—1.8 meter drops in several orientations as outlined in 49 C.F.R. § 178.603. Testing was done using a half liter Boston round bottle, (available from All-Pak Inc. ) filled with water and fitted with a phenolic screw top cap. Including the cap, the bottle had a length of 17.3 cm and a diameter of 7.43 cm. The weight of the bottle and its contents was 750 g. Results of the drop tests are set forth below in Table 1.

Example 2

A test package was assembled and tested as described in Example 1 with the exception that the filling fluid (fine steel shot filings in water) of the bottle had a density of 2.0 g/cm$^3$. The weight of the bottle and its fill was 1225 g. Results of the drop tests are set forth below in Table 1.

Example 3

Nonwoven webs were prepared as described in Example 1. A sleeve was produced by welding opposite edges of two 35cm×54 cm sheets of nonwoven web. Sheets were ultrasonically welded with the scrim side facing out as described in Example 1. Single weld lines were placed lengthwise along the 35 cm edges of the sheets. Welds were placed 2 cm from the edge of the sheets. A central opening having a circumference of 98 cm was provided to accept the bottle for testing.

The sleeve was evaluated using the bottle and drop tests outlined in Example 1. The weight of the bottle and its contents was 750 g. Lengthwise dimension of the sleeve was 202 percent of the length of the container.

A test package was assembled by placing the bottle in the sleeve lengthwise—top and bottom of the bottle towards the sleeve openings. The bottle was placed next to a welded se, am midway between the openings and was rolled in the crosswise direction of the sleeve. The sides of the bottle were surrounded by the nonwoven web, and portions of the nonwoven web projected axially from each end of the container. The bottle, rolled in the sleeve, was then placed into a 9.5×11.5×27 cm paper corrugated box of 1379 KPa burst strength (Liberty Carton Co.). The box was then taped closed and submitted to the prescribed series of drops. Results of the drop tests are set forth below in Table 1.

Example 4

A test package was assembled and tested as described in Example 3 with the exception that the filling fluid of the bottle had a density of 2.0 g/cm$^3$. The weight of the bottle and its fill was 1225 g. Results of the drop tests are set forth below in Table 1.

Example 5

Nonwoven webs were prepared as described in Example 1. A sleeve was produced by welding opposite edges of two 42 cm×60 cm sheets of finished web as described in Example 1. Parallel weld lines were placed lengthwise along the 60 cm edges of the sheets. Welds were placed 2 cm, 5 cm, and 8 cm from the top edge of the sheets with weld lines placed at 2 cm and 5 cm from the bottom edge. A central opening having a circumference of 58 cm was provided to accept the bottle for testing.

The sleeve was evaluated using drop tests outlined in Example 1. Testing was done using a one liter Boston round bottle, (available from All-Pak Inc. ) filled with water and fitted with a phenolic screw top cap. Including the cap, the bottle had a length of 21cm and a diameter of 9.36cm. The weight of the bottle and its contents was 1416 g. Crosswise dimension of the sleeve was 200% of the length of the container, and approximately 10.5 cm of web projected axially from each end of the container.

A test package was assembled by first placing the bottle crosswise (top of the bottle towards the sleeve end with three welds) in the opening of the sleeve. The bottle was then rolled in the lengthwise direction of the sleeve approximately one full turn with an additional overlap of about 9cm. Wrapped in the sleeve, the bottle was placed into a 12.5×12.5×32 cm paper corrugated box of 1379 KPa burst strength (Liberty Carton Co.). The box was taped closed and submitted to the prescribed series of drops. Results of the drop tests are set forth below in Table 1.

Example 6

A test package was assembled and tested as described in Example 5, except the filling fluid of the bottle had a density of 2.0 g/cm$^3$. The weight of the bottle and its fill was 2425 g. Results of the drop tests are set forth below in Table 1.

Example 7

Nonwoven webs were prepared as described in Example 1. A sleeve was produced by welding opposite edges of two 42 cm×60 cm sheets of finished web. Sheets were ultrasonically welded using the means described in Example 1 with the scrim side facing out. Single weld lines were placed in the lengthwise dimension along the 42 cm edges of the sheets. Welds were placed 2 cm from the edge of the sheets. A central opening having a circumference of 112 cm was provided to accept the bottle for testing.

The sleeve was evaluated using drop tests described in Example 1. Testing was done using a one liter Boston round bottle filled with water and fitted with a phenolic screw top cap as described in Example 5. Lengthwise dimension of the sleeve was 200 percent of the length of the container.

A test package was assembled by placing the bottle in the sleeve lengthwise—top and bottom of the bottle towards the sleeve openings. The top of the bottle was placed approximately 12 cm from the sleeve opening next to a weld seam and rolled in the crosswise direction of the sleeve one full turn with an additional overlap of about 1cm. The bottle, rolled in the sleeve, was then placed into a 12.5×12.5×32 cm paper corrugated box of 1379 KPa burst strength (Liberty Carton Co.). The box was then taped closed and submitted to the prescribed series of drops. Results of the drop tests are set forth below in Table 1.

Example 8

A test package was assembled and tested as described in Example 7 with the exception that the filling fluid of the bottle had a density of 2.0 g/cm$^3$. The weight of the bottle and its fill was 2425 g. Results of the drop tests are set forth below in Table 1.

Example 9

Nonwoven webs were prepared as described in Example 1. The webs measured 42 cm×120 cm. Each web was laid flat with the scrim side facing downward, and a one liter bottle was placed centrally on and parallel to the 42 cm edge of the finished web. A bottle was rolled towards the opposite 42 cm edge while the nonwoven web was juxtaposed against the side of the bottle. All of the web was wrapped around the bottle to fully surround its side. The bottle used was a one liter Boston round bottle as described in Example 5 which had a length of 21 cm. Thus, the 42 cm dimension was 200 percent of the length of the container, and approximately 10.5 cm of the web projected axially from each end of the bottle.

The sleeve was evaluated using drop tests as outlined in Example 1. The test package was assembled by placing the bottle, wrapped in the sleeve, into a paper corrugated box described in Example 5. The box was taped closed and subjected to the prescribed series of drops. Results of the drop tests are set forth below in Table 1.

TABLE 1

| Example Number | Bottle Size (liters) | Fill Density (g/cm$^3$) | Drop Test Result |
|---|---|---|---|
| 1 | 0.5 | 1 | Passed all drops |
| 2 | 0.5 | 2 | Passed all drops |
| 3 | 0.5 | 1 | Passed all drops |
| 4 | 0.5 | 2 | Passed all drops |
| 5 | 1.0 | 1 | Passed all drops |
| 6 | 1.0 | 2 | Failed side drop* |
| 7 | 1.0 | 1 | Passed all drops |
| 8 | 1.0 | 2 | Failed top drop* |
| 9 | 1.0 | 1 | Passed all drops |

*The escaped fluid and broken glass were retained by the sleeve.

The test results given in Table 1 demonstrate that for the constructions described in the Examples, a sleeve with a 200 percent dimension ratio will protect against drops of 1.8 meters for all cases except Examples 6 and 8, where one liter bottles were filled with a fluid have a density of 2 g/cm$^3$. In these Examples, additional cushioning material would be required to protect against the containers from the impacts associated with the drops. To provide further protection from impact from the side drop of Example 6, the sleeve could be wrapped another turn about the container, and to provide further protection from impact from the top drop of Example 8, the length of the sleeve in the lengthwise direction could be increased so that additional nonwoven web projects axially from the top end of the container. Although the container failed in Examples 6 and 8, the sleeve retained the broken glass and sorbed all of the escaped fluid to keep it in the immediate vicinity of the broken container.

This invention may take on various modifications and alterations without departing from the spirit and scope thereof. Accordingly, it is to be understood that this invention is not to be limited to the above-described, but is to be controlled by the limitations set forth in the following claims and any equivalents thereof.

What is claimed is:

1. An article for protecting a container that holds a fluid and sorbing the fluid in the container should the container fail, which article comprises:

a conformable sleeve that comprises a tubular body that has (i) an interior sized to receive the container that holds a fluid and (ii) an opening sized to permit the container to enter the interior of the tubular body, wherein the tubular body comprises a nonwoven web that contains at least 5 weight percent microfibers based on the weight of fibrous material in the nonwoven web, the nonwoven web having a solidity of less than about 0.2; and wherein the conformable sleeve has first and second bumper elements located on an exterior of the tubular body, the first and second bumper elements projecting laterally from the tubular body and extending longitudinally along the lengthwise dimension, the first and second bumper elements also comprise the nonwoven web that contains at least 5 weight percent microfibers and that has a solidity of less than about 0.2.

2. The article of claim 1, wherein the first and second bumper elements are integral with the tubular body.

3. The article of claim 1, wherein the tubular body of the sleeve has first and second openings at first and second ends of the tubular body.

4. The article of claim 3, wherein the nonwoven web comprises 50 to 100 percent microfibers.

5. The article of claim 1, wherein the nonwoven web has a solidity in the range of 0.03 to 0.2.

6. The article of claim 5, wherein the nonwoven web has a solidity in the range of 0.04 to 0.15.

7. The article of claim 1, wherein the nonwoven web has a basis weight in the range of 50 to 600 grams per square meter.

8. The article of claim 1, wherein the nonwoven web has a dry and wet tensile strength in the range of 2 to 8 newtons per centimeter.

9. The article of claim 1, wherein the nonwoven web has a fabric stiffness less than about 40 gram-centimeters.

10. The article of claim 1, wherein the nonwoven web has a sorbent capacity in the range of 5 to 40 grams $H_2O$ per gram web.

11. The article of claim 1, wherein the nonwoven web comprises 50 to 100 percent microfibers, has a solidity in the range of 0.06 to 0.12, has a thickness of 0.5 to 2 centimeters, has a basis weight in the range of 100 to 400 grams per square meter, has a sorbent capacity in the range of 15 to 20 grams $H_2O$ per gram of web, has a dry and wet tensile strength in the range of 4 to 8 Newtons per centimeter, has a fabric stiffness less than 20 gram-centimeters, and has a scrim bonded to at least one side of the nonwoven web.

12. The article of claim 1, wherein the nonwoven web further comprises staple fibers, microfiber microwebs, or combinations thereof.

13. The article of claim 12, wherein the nonwoven web comprises approximately 10 to 80 weight percent microfiber microwebs based on the weight of fibrous material.

14. The article of claim 1, wherein the nonwoven web contains discrete solid particles capable of interacting with the fluid in the container.

15. The article of claim 14, wherein the discrete solid particles are selected from the group consisting of activated carbon, alumina, sodium bicarbonate, silver, and combinations thereof.

16. The article of claim 1, wherein the conformable sleeve includes first and second nonwoven webs that contain at least 5 weight percent microfibers, the first and second nonwoven webs being bonded to each other by first and second parallel, spaced weld lines.

17. The article of claim 1, further comprising a container containing a hazardous fluid selected from the group consisting of acrylonitriles, alkaloids, bromine, caustic alkalis, 2-chloropropane, chlorosulphonic acid, cyanide solutions, diethyl ether, disinfectants, dyes, ethyl mercaptan, fluorosulphonic acid, furans, methyl formate, naptha, methanol, acetone, alcoholic beverages containing greater than 70 weight alcohol, battery fluids, benzene, carbon tetrachloride, chloroform, gasoline, n-Heptane, hexanes, isopropanol, methanol, nicotine, and sulfuric acid.

* * * * *

UNITED STATES PATENT AND TRADEMARK OFFICE

CERTIFICATE OF CORRECTION

PATENT NO.: 5,451,437

DATED: September 19, 1995

INVENTOR(S): Thomas I. Insley et al.

It is certified that error appears in the above-identified patent and that said Letters Patent is hereby corrected as shown below:

Col. 6, line 44, "FIG. I" should be --1--.

Col. 10, line 48, "se,am" should be --seam--.

Col. 13, line 33, after "to" insert --less than about--.

Signed and Sealed this

Twenty-sixth Day of December, 1995

*Attest:*

*Attesting Officer*

BRUCE LEHMAN

*Commissioner of Patents and Trademarks*